United States Patent [19]

Coggins et al.

[11] Patent Number: 4,915,782

[45] Date of Patent: Apr. 10, 1990

[54] ALUMINUM LITHIUM ETCHANT

[75] Inventors: Dolphus L. Coggins, St. Louis, Mo.; Walter E. Lindner, Plano, Tex.; Elias Malakelis, St. Louis, Mo.

[73] Assignee: McDonnell Douglas Corporation, St. Louis, Mo.

[21] Appl. No.: 287,917

[22] Filed: Dec. 21, 1988

[51] Int. Cl.[4] ..... C23F 1/00; B44C 1/22

[52] U.S. Cl. ..... 156/665; 156/656; 252/79.5

[58] Field of Search ..... 156/654, 665, 656, 659.1; 252/79.1, 79.5

[56] References Cited

U.S. PATENT DOCUMENTS

| | | | |
|---|---|---|---|
| 2,177,751 | 10/1939 | Sikorski | 41/42 |
| 2,434,021 | 1/1948 | Thompson | 41/42 |
| 2,647,864 | 8/1953 | Goffrede | 204/17 |
| 2,650,157 | 8/1953 | Cochran | 41/42 |
| 2,795,491 | 6/1957 | Newman et al. | 252/79.5 X |
| 2,890,944 | 6/1959 | Hays | 41/42 |
| 2,940,838 | 6/1960 | Snyder | 41/42 |
| 3,033,795 | 5/1962 | Brevik | 252/142 |
| 3,052,582 | 9/1962 | Snyder | 156/18 |
| 3,083,165 | 3/1963 | Carroll | 252/79.5 |
| 3,171,767 | 3/1965 | Bellinger | 156/20 |
| 3,230,172 | 1/1966 | Gasperini | 252/101 |
| 3,253,968 | 5/1966 | Shepherd | 156/19 |
| 3,301,719 | 1/1967 | Groshart | 148/6.21 |
| 3,356,550 | 12/1967 | Stiffer et al. | 252/79.5 X |
| 3,367,874 | 2/1968 | Haviland | 252/79.2 |
| 3,479,293 | 11/1969 | Bellinger | 252/79.4 |
| 3,557,000 | 1/1971 | Smith | 252/79.5 |
| 4,126,483 | 11/1978 | Donakowski et al. | 156/665 X |
| 4,264,377 | 4/1981 | Schafer | 148/6.14 R |
| 4,284,468 | 8/1981 | Stearns | 156/661.1 |
| 4,477,290 | 10/1984 | Carroll et al. | 252/79.5 X |
| 4,592,854 | 6/1986 | Lindner | 252/79.3 |

*Primary Examiner*—William A. Powell

*Attorney, Agent, or Firm*—Cohn, Powell & Hind

[57] ABSTRACT

A caustic etchant composition suitable for use on lithium containing aluminum alloys has between about 125 to 300 grams per liter of sodium hyroxide, between about 35 to 145 grams per liter of sodium sulfide, between about 0.5 to 4 percent by volume of triethanolamine, between about 1 to 10 grams per liter EDTA, between about 2 to 20 grams per liter sodium carbonate and the balance being water. The composition is effective to chemically etch lithium containing aluminum alloys and leave a smooth, clean chemically milled surface effective for use in chemically milled parts and free of stress concentrating surface characteristics.

20 Claims, 1 Drawing Sheet

ALUMINUM LITHIUM ETCHANT

BACKGROUND AND SUMMARY OF THE INVENTION

This invention relates to chemically milling of aluminum and in particular to a method and composition for etching and chemically milling lithium containing aluminum alloys.

Applicants are aware of the following U.S. Pat. Nos.: 2,177,751; 2,434,021; 2,647,864; 2,650,157; 2,890,944; 2,940,838; 3,033,795; 3,052,482; 3,171,767; 3,230,172; 3,253,968; 3,301,719; 3,367,874; 3,479,293; 4,264,377; 4,284,468; and 4,592,854. The disclosures of the above patents are incorporated by reference herein.

There are numerous methods and compositions known for etching metals. These prior methods and compositions are severely limited in effectiveness when applied to the lithium containing aluminum alloys, which have recently become available in commercially useful quantities. As a result, the art is generally using acid etchants for lithium containing aluminum alloys, and for alloy 2090 in particular. Acid etch solutions have inherent deficiencies when applied to aluminum alloys and it is desirable to caustic etch aluminum lithium alloys, if an effective etchant and method can be developed.

Lithium containing aluminum alloys have only recently been available to industry in commercial quantities. These alloys are highly desirable, particularly in the aircraft industries, due to their low density and high specific strength, that is, their very high strength to weight ratio. These alloys can have a significant weight saving advantage over conventional aircraft aluminum alloys, such as aluminum alloy 7075 and similar aluminum alloys. This weight and strength advantage makes the aluminum lithium alloys highly desirable since use of these alloys can result in a significant structural weight reduction without any loss in strength. This weight reduction in the aircraft industry translates into a greater payload for the same amount of fuel expended or a greater range for an equivalent payload. These are highly significant factors influencing the profitability and utility of the use of these alloys in the aircraft industry. However, for the alloy to have full utility in the aircraft industry, and in other industries, it must be susceptible to chemical milling so that excessive machining costs are not incurred in producing strong, lightweight parts.

The most desirable etching system for etching conventional aluminum alloys has been a caustic etch system. Caustic etch systems have an inherent advantage over acid etch systems for aluminum. The solubility of aluminum in acids is very low, typically from about 15 to 17 grams per liter at normal operating temperatures. The solubility of aluminum in caustic etchant may be as high as 70 grams per liter, or perhaps slightly more, at normal operating temperatures. Since caustic etchants have the greatest inherent solubility advantage, it would be desirable to etch aluminum lithium alloys in caustic baths. However, conventional caustic baths have proved highly unsatisfactory for lithium containing aluminum alloys. In particular, conventional caustic etch baths have produced highly irregular, coarse etched surfaces which are entirely unsuitable both from a cosmetic and a strength stand point. The surface produced by conventional caustic etchant on lithium containing aluminum alloys is irregular, rough, pitted and has a high degree of stress concentrating structures. These structures reduce the effective strength of the material and eliminate any inherent strength to weight advantage which lithium containing aluminum alloys have over conventional alloys. As a result, the industry regards caustic etchants as unsuitable for lithium containing aluminum alloys and as especially unsuitable for alloy 2090, the preferred alloy for many advanced designs. The art currently uses acid etchant systems, in spite of the low solubility of aluminum in acid and the additional disadvantage of having to find suitable methods of disposing of toxic acid waste products from the acid etchant baths.

Applicants' have discovered a caustic etchant and a method of etching aluminum lithium alloys using the caustic etchant that is effective to produce a smooth chemically milled surface which is free of stress concentrators and has a highly desirable cosmetic appearance. Applicants' caustic etchant has a high solubility for aluminum which permits an etchant solution to be used in an efficient manner to mill a large quantity of lithium containing aluminum material. Applicants' etchant does not contain any highly toxic chemicals so the spent etchant bath can be disposed of without creating an environmental hazard. The composition contains a caustic etchant material such as sodium hydroxide or other inorganic caustic etchant and a high proportion of inorganic sulfide, such as sodium sulfide or equivalent reactive sulfides. The bath may contain a nominal amount of aluminum to increase the activity of the etchant bath. Preferably, a chelating agent, such as an amine chelating agent, preferably triethanolamine or an equivalent chelating agent, is added to the etchant bath. In addition to these chelating agents, just described, we have found that small amounts of ethylenediaminetetraacetic acid (EDTA) and a soluble carbonate, such as sodium carbonate, are especially beneficial to improving fillet radii and undercut factors. The addition of the chelating agent eliminates the need for adding dissolved aluminum metal to the etchant bath as an activating agent, further extending the useful life of the etchant bath. Dissolved aluminum may be added, if desired. The soluble carbonate, chelating agent and EDTA, in combination, act as etch rate controlling compounds which provide a uniform etch of the alloy, preventing formation of stress concentrating structures and insuring a smooth, desirable milled surface.

Applicants' method of chemically etching or milling lithium containing aluminum alloys includes the preparation of sufficient quantity of the etchant in a suitable container or tank. The aluminum lithium parts to be etched or milled are immersed in the tank for the appropriate period of time to remove the desired amount of material. The components of the etchant, such as sodium hydroxide and sodium sulfide, can be replenished as they are consumed during etching or milling of the aluminum lithium alloy. Typically, the caustic chemical milling bath contains an inorganic hydroxide, such as sodium hydroxide, in an amount between about 125 to 300 grams per liter, contains an inorganic sulfide, such as sodium sulfide, in an amount between about 35 to 145 grams per liter and a complexing agent, such as triethanolamine, in an amount between about 0.5 to 4 percent by volume. The bath may also contain ethylenediaminetatraacetic acid in an amount between about 1.0 to 10.0 grams per liter and sodium carbonate in an amount between about 2.0 and 20.0 grams per liter of etchant. The remainder of the composition is essentially water. The inorganic sulfide, as noted above, is present in an amount sufficient to provide a sulfur concentration (as sulfide ion) in the bath of from about 15–60 grams per liter.

A preferred composition for the bath is between about 190 to 220 grams per liter of inorganic hydroxide, between about 100 to 120 grams per liter of inorganic sulfide (about 40–50 grams per liter of sulfur, as sulfide) and about 2 percent by volume of complexing agent. A preferred concentration for the additional complexing agent EDTA is between about 1.0 to 5.0 grams per liter, and the preferred concentration of sodium carbonate is between about 2.0 to 8.0 grams per liter of etchant.

Applicant's invention has been found highly effective at chemically milling aluminum lithium alloys, including the hard to mill alloy 2090. To date this etchant has not been as effective at milling conventional aluminum alloys, such as alloy 7075, as are conventional caustic etchant systems. The sodium carbonate, or an equivalent carbonate, is especially helpful, as applicants have discovered, at improving the performance of the bath in etching fillet radii and in reducing undercut, and also substantially increasing the effective life of the bath. The added carbonate greatly reduces replating of lithium (or lithium complex) on the workpiece, which would interfere with the etch rate. The added carbonate effectively removed dissolved lithium from the etch path by precipitating low solubility lithium carbonates and complexes.

The invention may be more fully understood by referring to the following Description of the Drawings and Description of the Preferred Embodiments.

DESCRIPTION OF THE PREFERRED EMBODIMENTS

The invention is a caustic etchant and milling composition which is effective to chemically mill lithium containing aluminum alloys and the method of its use.

The invention is shown in the following examples:

EXAMPLE 1

Figure 1:
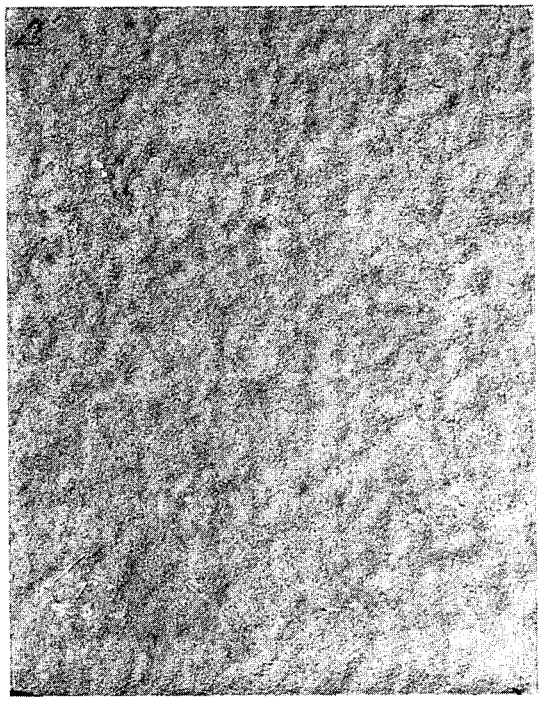
FIG. 1 is a photomicrograph of an etched coupon of 2090 aluminum lithium alloy.

A liter of a comparative etchant was made by mixing the following ingredients:

350 ml of 50% NaOH
20 ml of triethanolamine
12 grams sulfur (as $Na_2S$)
Water to one liter This solution was used on a 2090 aluminum lithium alloy coupon for 25 minutes. After treatment the aluminum lithium coupon was examined, the surface was highly irregular and rough having a coarse bumpy structure having numerous stress concentrators. The surface produced was considered to be highly unsuitable for an aircraft part. The surface of the coupon is shown in the photomicrograph of FIG. 1.

EXAMPLE 2

Figure 2:
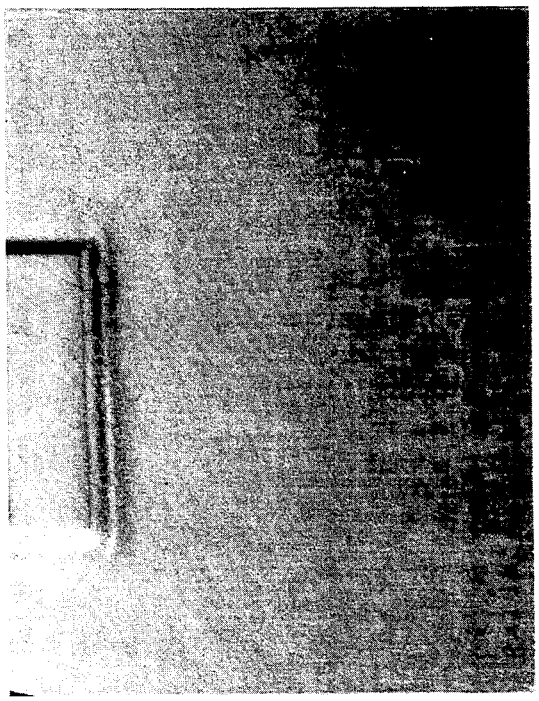
FIG. 2 is a photomicrograph of an etched coupon of 2090 aluminum lithium alloy.

A liter of applicants' etchant was made by mixing the following ingredients:

200 ml of 50% NaOH
20 ml of triethanolamine
50 grams sulfur (as $Na_2S$)
2 grams ethylenediaminetetraacetic acid
5 grams sodium carbonate
Water to one liter This solution was used on a measured 2090 aluminum lithium alloy coupon for 25 minutes. After treatment the surface was examined. The surface appeared smooth, clean and uniform, the part was measured and 0.075 inch of material had been removed from the surface of the coupon. The milled surface was judged to be smooth and free of stress concentrators and suitable for an aircraft part. The surface of the coupon is shown in the photomicrograph of FIG. 2.

EXAMPLE 3

A liter of applicant's etchant was made by mixing the following ingredients:

200 ml of 50% NaOH
20 ml of triethanolamine
50 grams sulfur (as $Na_2S$)
2 grams ethylenediaminetetraacetic acid
5 grams sodium carbonate
25 grams dissolved aluminum
Water to one liter This solution was used on a measured 2090 aluminum lithium alloy coupon for 25 minutes. After treatment the surface was examined. The surface appeared smooth, clean and uniform, the part was measured and 0.075 inch of material had been removed from the surface of the coupon. The milled surface was judged to be smooth and free of stress concentrators and suitable for an aircraft part.

EXAMPLE 4

A liter of etchant was made by mixing the following ingredients:

200 ml of 50% NaOH
20 ml of triethanolamine
50 grams sulfur (as $Na_2S$)
2 grams ethylenediaminetetraacetic acid
5 grams sodium carbonate
50 grams dissolved aluminum
Water to one liter This solution was used on a measured 2090 aluminum lithium alloy coupon for 25 minutes. After treatment the surface was examined. The surface appeared smooth, clean and uniform, the part was measured and 0.075 inch of material had been removed from the surface of the coupon. The milled surface was judged to be smooth and free of stress concentrators and suitable for an aircraft part.

It will be appreciated by one skilled in the art that various modifications may be made in the specific embodiments disclosed herein without departing from the invention. The examples are included herein for illustrative purposes. The scope of the invention is to be limited only by the following claims and their equivalents.

We claim:

1. A caustic etchant composition effective to chemically mill lithium containing aluminum alloys, the composition consisting essentially of an aqueous solution of an inorganic hydroxide, an inorganic sulfide and an etch rate controller, the inorganic hydroxide and the inorganic sulfide being combined in the solution in amounts effective to etch alloy 2090 lithium containing aluminum alloy, the etchant in combination with the etch rate controller, being effective to achieve a uniform, rapid etch and produce smooth chemically milled surfaces, in alloy 2090 lithium containing aluminum alloy, suitable for use in structures requiring a high strength to weight ratio and uniform stress distribution.

2. The etchant composition of claim 1 comprising between about 125 to 300 grams per liter of an inorganic hydroxide.

3. The etchant composition of claim 1 containing between about 35 to 145 grams per liter of an inorganic sulfide.

4. The etchant composition of claim 1 wherein the inorganic hydroxide is sodium hydroxide.

5. The etchant composition of claim 1 wherein the inorganic sulfide is sodium sulfide.

6. The etchant composition of claim 1 further comprising an amine chelating agent.

7. The etchant composition of claim 6 wherein the amine chelating agent is triethanolamine and wherein the etchant contains between about 0.5 to 4 percent by volume of triethanolamine.

8. The etchant composition of claim 1 wherein the etch rate controller includes EDTA and a soluble carbonate.

9. The etchant composition of claim 1 wherein the etchant composition contains between about 190 to 220 grams per liter of sodium hydroxide, between about 100 to 120 grams per liter of sodium sulfide, about 2 percent by volume of triethanolamine, between about 100 to 120 grams per liter of sodium sulfide, about 2 percent by volume of triethanolamine, between about 1 to 5 grams per liter of EDTA and between about 2 to 8 grams per liter of sodium carbonate.

10. A caustic etchant composition effective on alloy 2090 lithium containing aluminum alloy, the etchant composition consisting essentially of between about 125 to 300 grams per liter of sodium hydroxide, between about 35 to 145 grams per liter of sodium sulfide, between about 0.5 to 4 percent by volume of triethanolamine and an etch rate controller, the balance being essentially water, the composition being effective to dissolve between about 50 to 70 grams per liter of aluminum from alloy 2090 lithium containing aluminum alloy and being effective to remove a portion of the alloy and chemically mill a surface of the alloy to provide a smooth, uniform, chemically milled surface effective to be incorporated in high strength to weight ratio parts free from stress concentrating surface characteristics.

11. The caustic etchant composition of claim 10 wherein the etchant composition is one consisting of essentially of between about 190 to 220 grams per liter of sodium hydroxide, between about 100 to 120 grams per liter of sodium sulfide, about 2 percent by volume of triethanolamine, between about 1 to 5 grams per liter of EDTA and between about 2 to 8 grams per liter of sodium carbonate.

12. A method of caustically etching alloy 2090 lithium containing aluminum alloy effective to uniformly and smoothly etch the alloy comprising etching the alloy in an etchant bath containing between about 1250 to 300 grams per liter of an inorganic hydroxide, between abut 35 to 145 grams per liter of an inorganic sulfide, and an etch rate controller, including an aluminum complexing agent, the etchant bath containing inorganic hydroxide and inorganic sulfide in amounts effective to etch the alloy and, in combination with the etch rate controller, being effective to produce a smooth, uniform chemically milled surface free of stress concentrating surface features.

13. The method of claim 12 wherein the etchant bath contains sodium hydroxide.

14. The method of claim 12 wherein the etchant bath contains sodium sulfide.

15. The method of claim 12 wherein the etchant bath contains an amine chelating agent.

16. The method of claim 15 wherein the amine chelating agent is triethanolamine.

17. The method of claim 16 wherein the etchant bath contains between about 0.5 to 4 percent by volume of triethanolamine.

18. The method of claim 12 wherein the etchant bath is one consisting essentially of between about 190 to 220 grams per liter of sodium hydroxide, between about 100 to 120 grams per liter of sodium sulfide and about 2 percent by volume of triethanolamine.

19. The method of claim 18 wherein the etchant bath contains between about 1 to 5 grams per liter of EDTA.

20. The method of claim 18 wherein the etchant bath contains between about 2 to 8 grams per liter of sodium carbonate.

* * * * *

UNITED STATES PATENT AND TRADEMARK OFFICE

CERTIFICATE OF CORRECTION

PATENT NO. : 4,915,782

DATED : April 10, 1990

INVENTOR(S) : Coggins et al.

It is certified that error appears in the above-identified patent and that said Letters Patent is hereby corrected as shown below:

ABSTRACT, line 3, delete "hyroxide" and insert --hydroxide--

Col. 1, line 12, delete "3,052,482" and insert --3,052,582--

Col. 3, line 15, delete "Applicant's" and insert --The--

Col. 4, line 16, delete "applicant's" and insert --the--

Col. 6, line 4, delete "1250" and insert --125--

Col. 6, line 16, delete "abut" and insert --about--

Signed and Sealed this

Eighteenth Day of June, 1991

*Attest:*

*Attesting Officer*

HARRY F. MANBECK, JR.

*Commissioner of Patents and Trademarks*